US010874177B2

(12) United States Patent
Ben-Arie

(10) Patent No.: US 10,874,177 B2
(45) **Date of Patent: *Dec. 29, 2020**

(54) BELT RATCHETING DEVICE III

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/792,324

(22) Filed: Feb. 17, 2020

(65) Prior Publication Data

US 2020/0281327 A1 Sep. 10, 2020

Related U.S. Application Data

(63) Continuation-in-part of application No. 16/297,655, filed on Mar. 9, 2019, now Pat. No. 10,602,807.

(51) Int. Cl.
*A44B 11/12* (2006.01)

(52) U.S. Cl.
CPC ..... *A44B 11/12* (2013.01)

(58) Field of Classification Search
CPC ..... A44B 11/12; A41F 9/002; A43C 11/14; A43C 11/20; A43C 1/00; A43C 7/04; A43C 7/08; F16G 11/105
See application file for complete search history.

(56) References Cited

U.S. PATENT DOCUMENTS 5,740,591 A * 4/1998 Hopkins ..... A44B 11/12 24/164
5,901,418 A * 5/1999 Hopkins ..... A44B 11/12 24/164
2007/0240286 A1* 10/2007 Kawaguchi ..... A44B 11/12 24/191
2010/0011487 A1* 1/2010 Kim ..... A44B 11/006 2/300
2011/0247179 A1* 10/2011 Bellamy ..... A61B 17/1327 24/19
2013/0185902 A1* 7/2013 Kaneko ..... A44B 11/12 24/324
2017/0258160 A1* 9/2017 Rowland ..... A41F 9/002
2019/0357635 A1* 11/2019 Bessho ..... A44B 11/12

* cited by examiner

*Primary Examiner* — Robert Sandy
*Assistant Examiner* — David M Upchurch

(57) ABSTRACT

The Belt Ratcheting Device (BRD) facilitates unidirectional belt fastening and fast release. The BRD includes a turning gate rotatably installed diagonally in a channel. The turning gate has a blade holder with sharp blade front. Attached at the rear is a resilient plate which acts as a spring. The BRD has two states: "active" and "inactive". In the active state the device works as a belt ratchet i.e. allowing the belt to be pulled forwards but restricting any belt motion backwards. In the inactive state the ratcheting is disabled and the belt is released. Usually, the BRD is kept in active state by a preloaded resilient plate. After fastening, the belt remains fastened until the BRD is switched manually into inactive state by pulling a latch. The blade's smooth side and channel's smooth surfaces minimize belt wear. BRDs facilitate belt fastening for garments and footwear.

15 Claims, 6 Drawing Sheets

BELT RATCHETING DEVICE III

CROSS-REFERENCE TO RELATED APPLICATIONS

This Application is Continuation In Part of application Ser. No. 16/297,655 Filed on Mar. 9, 2019

FEDERALLY SPONSORED RESEARCH

Not Applicable

SEQUENCE LISTING OR PROGRAM

Not Applicable

FIELD OF THE INVENTION

The invention is related to devices for fastening and keeping fastened belts, bands, straps, ribbons, cloth belts, suspenders, sandals, brassieres, watch bands, garment belts strips, laces chords, ropes, strings and alike.

BACKGROUND OF THE INVENTION

Prior Art

Several inventions were concerned with ratchet mechanisms configured for fastening waist belts. In U.S. Pat. No. 5,588,186A Soon-Myung Ko filed in 1995 May 26 a patent which teaches a belt with improved ratchet type buckling means. The ratcheting mechanism was constructed by a toothed belt and a releasable pawl in the buckle. In Application US20150113770A1 filed on 2014 Mar. 18 Robin LaatzKore taught a ratchet belt system which comprised a belt with a notch strip which extends along a portion of the length of the belt. The notch strip is formed of a plurality of adjacent notches, each being configured to engage a ratcheting pawl in the buckle. In principle, the notch strip is very similar to the toothed belt. Another invention which teaches a similar structured ratchet mechanism is presented by Jong Lee in application filed on 2004 May 7. The structure of toothed belt and similarly a notch strip belt is quite expensive to manufacture and is susceptible to accelerated wear since the imprinted belt is made of soft material. Furthermore, the ratchet pawl applies a strong shear force which equals to the total fastening force just on one tooth of the toothed belt. This shear force plays a major role in the belt's accelerated wear. In addition, the toothed structure is configured to provide fastening stations only at discrete spaces along the belt. In contrast, our invention does not suffer from these drawbacks.

Another prevalent approach for belt ratcheting is based on a ratchet wheel which rotates while mechanically linked to a cylinder with rough surface which compresses and fastens the belt. Such are the invention of Smetz-Rud Ketten et al. in patent application DE3344489A1 filed on 1983 Dec. 6. Also in U.S. Pat. No. 5,647,824A filed on 1995 Oct. 25, Levenson teaches a Weight lifter's belt incorporating strap fastened by a ratchet wheel. In U.S. Pat. No. 7,100,901B2 filed on 2001 Jun. 28 Gerhard Gleinser taught a Tension ratchet with a belt magazine also utilizing a ratchet wheel mechanism. Ratchet wheel mechanism is utilized in many other belt fastening inventions. In another approach, described in application Ser. No. 16/297,655 filed on Mar. 9, 2019 Jezekiel Ben-Arie taught a belt ratcheting device which employs an adaptive blocking mechanism which restricts belt motion backwards by a turning gate which applies an increasing pressure force on the belt, which is proportional to the backwards pulling force, when the turning gate is turned backwards by the belt motion backwards. The adaptive blocking mechanism facilitates belt motion forwards by the turning gate which diminishes the pressure force on the belt when the turning gate is turned forwards by the belt motion forwards. However, as detailed in the following sections, the adaptive blocking mechanism of Ben-Arie's ratcheting device has different structure compared to the belt ratcheting device described in the current application.

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forwards and narrows backwards. The laces pass through that passage and can be fastened by pulling the laces forwards which in turn pulls forwards the gear wheel towards the wider part of the passage where the laces are free to move. When the pulling stops the laces pull the gear wheel backwards, which narrows the passage and blocks the laces' backwards motion. The laces can be released by pulling the gearwheel forwards with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in open position with the other hand and then switching the buckle into locked position. This results in cumbersome and inefficient fastening.

In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which. have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before.

Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jih-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Device. U.S. Pat. No. 6,282,817 to Curet teaches an Apparatus and Method for Lacing.

US PATENT APPLICATIONS

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/025068 to Stramare describes a Shoe with Directional Conditioning Device for lace or the like. In US 2007/0169380 to Borsoi teaches a Device for B Flexible Strands. In US 2006/0213085 to Azam teaches an Article for Footware with Linkage Tightening Device. In US 2005/0005477 to Borsoi teaches a Lace B Device. In US 2003/0226284 to Grande teaches a Lacing System For Skates. In US 2002/0002781 to Bourier teaches a Lace Tightening Device Having a Pocket for Storing a B Element.

BRIEF SUMMARY OF THE INVENTION

The objective of the invention of the Belt Ratcheting Device (BRD) is to achieve the following goals:

1. A major goal of the invention is to configure a Belt Ratcheting Device (BRD) that facilitates a linear and continuous ratcheting of belts. A ratcheting mechanism that enables to fasten a large variety of belts. It is desired that the configuration of the ratcheting mechanism will be based on a novel structure which yields a linear, continuous and smooth ratcheting. A continuous ratcheting method which is entirely different from traditional discrete ratcheting methods which employ a pawl and require a pattern belt imprinting such as: notch strips or toothed surfaces. Our novel ratcheting mechanism employs a turning gate with a blade front which is installed diagonally in a channel and allows only unidirectional belt translation. This BRD does not need belt imprinting and enables fastening of a large variety of smooth surface belts made not just of leather but also of cloth, plastics or other elastic materials.
2. A second target of the invention is to develop a BRD that allows to achieve an accurate level of fastening i.e. the user has just to pull the belt exactly to the desired level of fastening and the belt does not slip and remains fastened at the desired level after the pulling ceases. This entails that the BRD is to be configured to have a slip less, continuous ratcheting mechanism, which strongly restricts belt motion backwards but facilitates forwards motion of the belt.
3. A third objective of the invention is to design a BRD with a linear ratcheting mechanism which is mechanically more reliable because it depends on a simple structure which employs a minimal number of moving parts and therefore minimizes malfunction probability.
4. A fourth goal of the invention is to design a BRD with a linear ratcheting mechanism which causes minimal belt wear.
5. A fifth target of the invention is to design a BRD with a releasing mechanism which is quick and easy to operate manually. The BRD is configured to be switched from active fastening state to inactive state simply by pulling a latch which releases a leaf spring which opens the turning gate and releases the belt.

6. A sixth objective of the invention is to design a BRD with a ratcheting mechanism structure, which is suited for low cost manufacturing and assembly because it has a simple structure which employs minimal number of moving parts. Furthermore, in order to facilitate low cost manufacturing, the BRD is designed to be manufactured from plastic materials in its entirety except for a metallic blade. In order to achieve low cost production, the BRD design avoids usage of metallic springs and configures all the required springs from resilient plastic materials.
7. A seventh objective of the invention is to configure a BRD with low profile which is suitable also for fastening belts of footwear, garments, brassieres, watches or any other objects which use belts.

This specification describes an embodiment of the invention that is a belt ratcheting configuration which has a belt ratcheting mechanism which is designed for ratcheting a large variety of belts which have different thicknesses and widths and are made of different materials. This embodiment also facilitates easy fastening of belts, laces, ropes, strings and alike. The basic Belt Ratcheting Device (BRD) can be configured to have a small size and thus it can be used to fasten belts, bands, straps, ribbons, waist belts, suspenders, sandals, brassieres, watch bands, garment belts, and any sort of belts or bands connected to or used for wrapping of objects which need fastening. The BRD can be used to fasten a belt simply by inserting the belt into the BRD and pulling it. The BRD has a linear ratcheting mechanism with two states: "active" and "inactive". In the inactive state the ratcheting mechanism is disabled and the belt is free to move forwards and backwards. In the active state the device works as a linear belt ratchet i.e. allowing the belt to be pulled forwards but severely restricts or even completely blocks any belt motion backwards. After the user has fastened the belt it remains fastened until the mechanism is switched into the inactive state. The BRD ratcheting mechanism can be regarded also as an adaptive blocking mechanism which applies on the belt a blocking pressure which is proportional to the backwards pulling force applied to the belt. This adaptive blocking mechanism is adaptive and restricts backwards belt motion very efficiently because it generates a pressure force which results in a friction based belt blocking force which is proportional to the belt's backwards pulling force. So, the hardest the belt is pulled backwards the strongest is the blocking force which prevents it from moving backwards.

The BRD has a channel for fastening one belt. In the embodiment described here, the channel comprises of four walls: a gripping wall, a top wall opposite to the gripping wall, a lower side wall approximately normal to the gripping wall and an upper side wall opposite and parallel to the lower side wall. The channel includes two major openings: an entrance for the belt and an exit for the belt. The forwards direction in the channel is defined as the direction from the entrance to the exit. The backwards direction is opposite to the forwards direction. A turning gate is rotatably installed in the channel on an axle, which is supported by two bearings installed in the upper and lower side walls. The axle is centered at the turning gate's fulcrum i.e. support and also the turning gate's axis of rotation. The turning gate comprises of a blade holder at the turning gate's front end and an elastic part at the turning gate's rear end. The axis of rotation is situated between the front end and the rear end. The blade holder holds a blade which includes a blade front. The blade is inserted into the blade holder such that the blade front protrudes in front of the blade holder. The blade is tapered gradually narrowing towards the blade front and ending with a sharp blade front, which protrudes in front of the blade holder. The sharp blade front is adapted with a smooth side. The sharp blade front is configured to concentrate the pressure force on the belt when the turning gate is turned backwards while the sharp blade front engages the belt. The smooth side is configured to engage the belt when the turning gate is turned forwards. The smooth side is configured to reduce the belt wear while the turning gate is turned forwards and the belt is translated in the forwards direction.

The surface of the gripping wall is adapted with a smooth surface. The smooth surface is configured to reduce the belt wear when the belt is fastened forwards at the active state and also when the belt is translated in the inactive state.

As an option, the BRD may comprise one or more bulges, which are disposed on the surface of the gripping wall. Each bulge is configured to cause an additional bending of the belt due to the pressure force. The additional bending is configured to increase a mutual friction force between the belt and the surface of the gripping wall while the BRD is in the active state and the belt is pulled in the backwards direction.

As another option, the gripping wall could comprise a recess opposite the blade front end. The recess is configured to cause an additional bending of the belt due to the pressure force. The additional bending is configured to increase the mutual friction force between the belt and the surface of the gripping wall while the BRD is in the active state and the belt is pulled in the backwards direction.

The turning gate is installed in the channel such that a straight line emanating from the blade front and passing through the axis of rotation (i.e. fulcrum) is at an obtuse angle with respect to the forwards direction. It means that the obtuse angle which is centered at the blade front and is measured between the two lines emanating from the angle's center (the blade front). One line starts at the angle's center and passes through the axis of rotation and the second line starts at the angle's center and is parallel to the forwards direction of the channel. The blade front is disposed within the channel opposite the gripping wall and there exist a gap between the blade front and the gripping wall. The belt transported in the channel is configured to pass through the gap between the blade front and the gripping wall.

Due to the diagonal construction of the turning gate in the channel, when the turning gate is turned increasingly backwards, the turning gate is configured to reduce the gap and consequently to increase the pressure force exerted by the blade front on the belt. On the other hand, due to the diagonal construction of the turning gate in the channel, when the turning gate is turned increasingly forwards, the turning gate is configured to increase the gap and consequently to reduce the pressure force exerted by the blade front on the belt.

When the BRD is at the active state, the blade front is configured to exert the pressure force on the belt. Since the blade front is configured to frictionally engage the belt it is also configured to turn forwards the turning gate when the belt is translated in forwards direction. Similarly, at the active state the blade front is configured to frictionally engage the belt and to turn backwards the turning gate when the belt is translated in backwards direction.

The turning gate is configured to facilitate forwards translation of the belt by turning increasingly forwards and consequently diminishing the pressure force of the blade front on the belt. The turning gate is configured to restrict backwards translation of the belt by turning increasingly backwards and consequently increasing the pressure force of the blade front on the belt. Hence, in the active state of the BRD the turning gate is configured to allow only unidirectional translation of the belt in the forwards direction. Whereas at the inactive state of the ratcheting device, the blade front is configured not to exert pressure force on the belt and translation of the belt is facilitated both in the forwards direction and in the backwards direction.

The elastic part which is the turning gate's rear end, is structured as a resilient plate which acts as a flat spring which is attached to the blade holder which is situated at the turning gate's front end. While in the active state, the resilient plate is configured to be at a bent state (biased state) and is configured to apply said backwards turning force on the turning gate. The backwards turning force is configured to turn the turning gate backwards, which is configured to reduce the gap and to apply a pressure force on the belt. Thus, at the active state the turning gate is configured to apply a pressure force on the belt.

While in the active state, the resilient plate is held in the bent state by a latch which is resiliently attached to a middle floor wall of the ratcheting device. When manually pulled, the latch is configured to release the resilient plate from its bent state. The turning gate is configured to turn forwards and to diminish the backwards turning force when the resilient plate is released and to switch the ratcheting device from the active state into the inactive state.

In order to facilitate BRD switching from the active state into the inactive state, the resilient plate is attached to a leaf spring at a leaf spring first end wherein the leaf spring second end is unattached and is situated below the resilient plate. When the resilient plate is rotated downwards towards the active state, the first end of the leaf spring is configured to move downwards as well and the second end of the leaf spring is configured to be pressed against the middle floor wall of the ratcheting device while bending the leaf spring. When the ratcheting device is at the active state and the latch is pulled, the resilient plate is configured to turn forwards the turning gate and the bent leaf spring is configured to be released and to facilitate turning forwards the resilient plate along with the turning gate towards the inactive state.

The elastic part is being configured also to serve as a lever for manually switching the ratcheting device from the active state into the inactive state by manually turning up the resilient plate which also turns forwards the attached turning gate and consequently diminishes the pressure force exerted by the blade front on the belt. The elastic part is being configured also to serve as a lever for manually switching the ratcheting device from the inactive state into the active state by manually turning down the resilient plate which also turns backwards the attached turning gate and consequently increases the pressure force exerted by the blade front on the belt.

When the ratcheting mechanism is in active state, the gap has been narrowed such that the blade front (i.e. front end) applies a pressure force which is squeezing the belt in the channel with its blade front i.e. the sharp blade front. At this situation, the turning gate acts as a belt ratchet. It means that the turning gate allows forwards fastening motion of the belt but blocks or severely restricts any belt translation in backwards direction. In order to have a belt ratchet operation, the turning gate is installed in a forwards leaning diagonal orientation in the channel such that its blade front is closer to the gripping wall than its axis of rotation. Also, in a forwards leaning diagonal state, the turning gate's blade front (front end) is closer to the channel's exit than the turning gate's axis of rotation.

The ratchet operation of the gate stems from the forward leaning diagonal orientation of the turning gate, which allows forwards belt motion when the belt is pulled forwards. Pulling forwards the belt which is squeezed in the gap, drags the turning gate's blade front forwards due to the friction force which naturally exists between the belt and the blade front as a natural consequence of the pressure force applied by the blade front on the belt. Thus, when the front end is dragged forwards also the turning gate turns forwards. Due to the forwards leaning diagonal orientation of the turning gate, when its blade front is turned forwards it is moved forwards and it also has a motion component that moves it laterally inwards i.e. away from the gripping wall, whereby increasing the width of the gap between the blade front and its gripping wall which in turn results in diminished pressure force of the blade front on the belt. Reduced pressure force on the belt results in reduced friction between the belt and the surface of the gripping wall and also reduced friction between the belt and the blade's front. This facilitates even easier forwards motion of the belt.

On the other hand, if the belt is pulled backwards it also drags the turning gate's blade front backwards (i.e. turning backwards) since the blade front applies a squeezing force on the belt, which results in a mutual friction force with the belt. Hence, when the blade front moves backwards also the turning gate turns backwards as well. Due to the forwards leaning diagonal orientation of the gate, the motion backwards of the blade front has also a lateral outwards motion component which moves the blade front (at the front end) towards the gripping wall thus further narrowing the gap and further restricting backwards belt motion. Hence, in an active state the gate acts as a belt ratchet i.e. allows belt forwards motion but severely restricts belt's backwards motion. When the ratcheting mechanism is switched into inactive state by turning the turning gate forwards, the gap is widened more than the belt's width and the belt is entirely released because it can move freely forwards or backwards in the channel. The user can easily switch the ratcheting mechanism from active to inactive state simply by manually turning up the resilient plate which also turns forwards the attached turning gate. When the gate turns forwards and increases the gap's width it also inactivates the ratchet mechanism of the BRD. On the other hand, when the resilient plate is turned down, it also turns the attached turning gate backwards into the active state. The BRD can be manufactured at low cost because it has a simple structure with only few parts, which could be made from plastic materials at its entirety except the metallic blade.

The BRD's structure is different from other belt fastening devices in few important aspects. Primarily, the BRD enables a belt ratcheting operation which causes only minimal wear of the belt since it employs in the channel a novel structure with a diagonally forwards leaning turning gate with a single tapered blade front at its front end, i.e. single sharp blade front which is configured to have a smooth side (for certain applications, such as in controlling wide belts, the front end can be split into several blades if more efficient). When the belt is moved forwards, the tapered blade end i.e. sharp blade front at the front end of the turning gate rotates forwards this also turns the smooth side of the tapered end to be approximately parallel with the belt and the belt is sliding on the smooth side of the tapered end i.e. causing minimal wear of the belt. To further reduce belt's wear, we also configured a smooth surface to the gripping wall opposite to the blade front (i.e. front end) as well. Also, when the BRD is in inactive state, the gate is in forwards rotation, which also widens the gap more than the belt's width this eliminates belt friction and wear while the belt is moved forwards. Since the belt is blocked from moving backwards in the active state, there is no belt wear in the backwards motion as well. In addition, the BRD's gripping wall is manufactured with a smooth surface to minimize belt wear when it moves in the gap as well. In contrast, other belt fastening devices employ serrated surfaces with sharp teeth structures which are designed to block belt movement while in blocked state. However, sharp teeth structures cause significant belt wear even when they are in their unblocked state since their teeth remain pointed at the belt and the belt still touches them as it moves even in a wider gap. In our BRD the sharp front end could be split into two or more separate blades which engage the belt simultaneously at different lateral locations.

The BRD has many advantages over previous devices primarily due to its efficient and easy fastening operation by a ratchet mechanism which requires the user just to pull the belt to the desired fastening level. Once the belt is pulled, it remains fastened until the ratcheting mechanism is switched from active state into inactive state whereby it disables the ratchet mechanism and releases the belt. Additional advantage over all the other belt ratchets is that its ratchet mechanism does not use belt imprinted toothed strips. Fastening belts with ratchet devices which have belt imprinted surfaces, which regularly have sharp teeth, as all other ratchet belt fasteners do, results in fast wear of the imprinted strips on the belts. As a consequence, the ratchet mechanisms of such devices malfunctions after short use. In contrast, the diagonal orientation of the tapered i.e. sharp edges at the sharp blade fronts of the turning gates in the BRDs, cause very little belt wear because each sharp blade front has a smooth side on which the belt can slide when it is fastened. The BRD was worn and tested daily by the Applicant for more than a year on various belts without any noticeable belt wear.

DETAILED DESCRIPTION OF THE DRAWINGS

Figure 1:
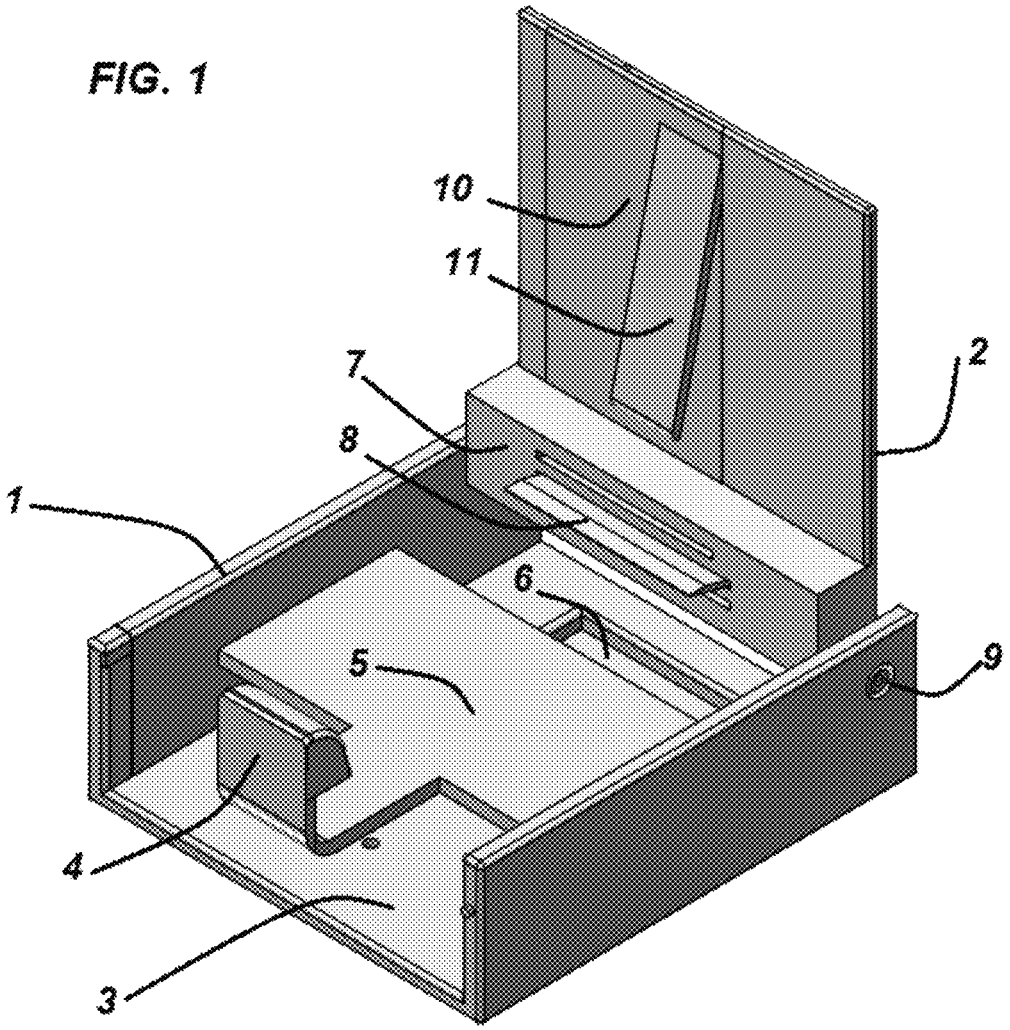
FIGS. 1 and 2 illustrate two views of 3D isometric drawings of an embodiment of a Belt Ratcheting Device (BRD).
Figure 2:
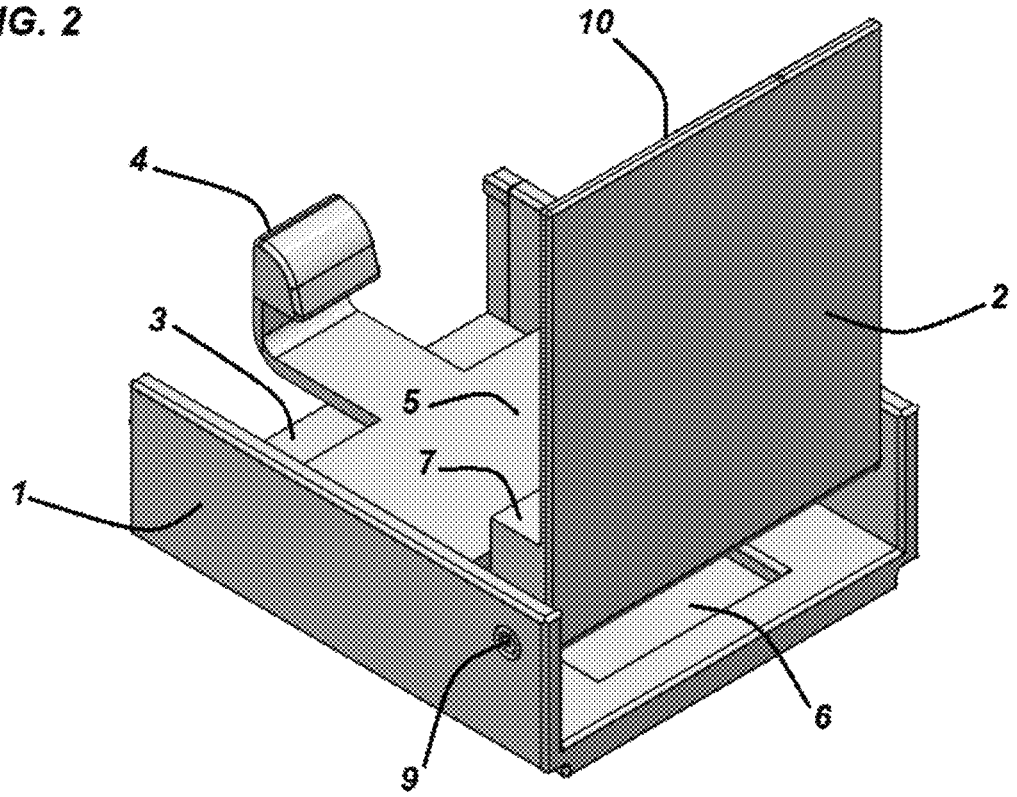

FIGS. 1 and 2 illustrate two views of 3D isometric drawings of an embodiment of a Belt Ratcheting Device (BRD). The BRD's channel 1 includes the gripping wall 3 at the bottom which also has a recess 6 configured to increase the friction and the restricting force of blocked belts. Parallel and above the gripping wall there is the middle floor wall 5, which is resiliently connected to the latch 4. The turning gate 2 which is turned upwards (backwards) and is in inactive state in FIGS. 1 and 2. The blade holder 7 holds the blade 8 in one of 3 slots engraved in the blade holder 7. The turning gate turns on axes 9 which are inserted in bearings in the upper and lower side walls of the channel 1. The resilient plate 10 is the elastic part of the turning gate 2, which is attached to the blade holder 7. The resilient plate 10 is in unbent state in FIGS. 1 and 2 since the BRD is in inactive state. One end of the leaf spring 11 is attached to the lower face of the resilient plate 10. The other end of the leaf spring 11 is configured to be pressed against the middle floor wall 5 when the resilient plate 10 is turned backwards (down) when the BRD is in active state.

Figure 3:
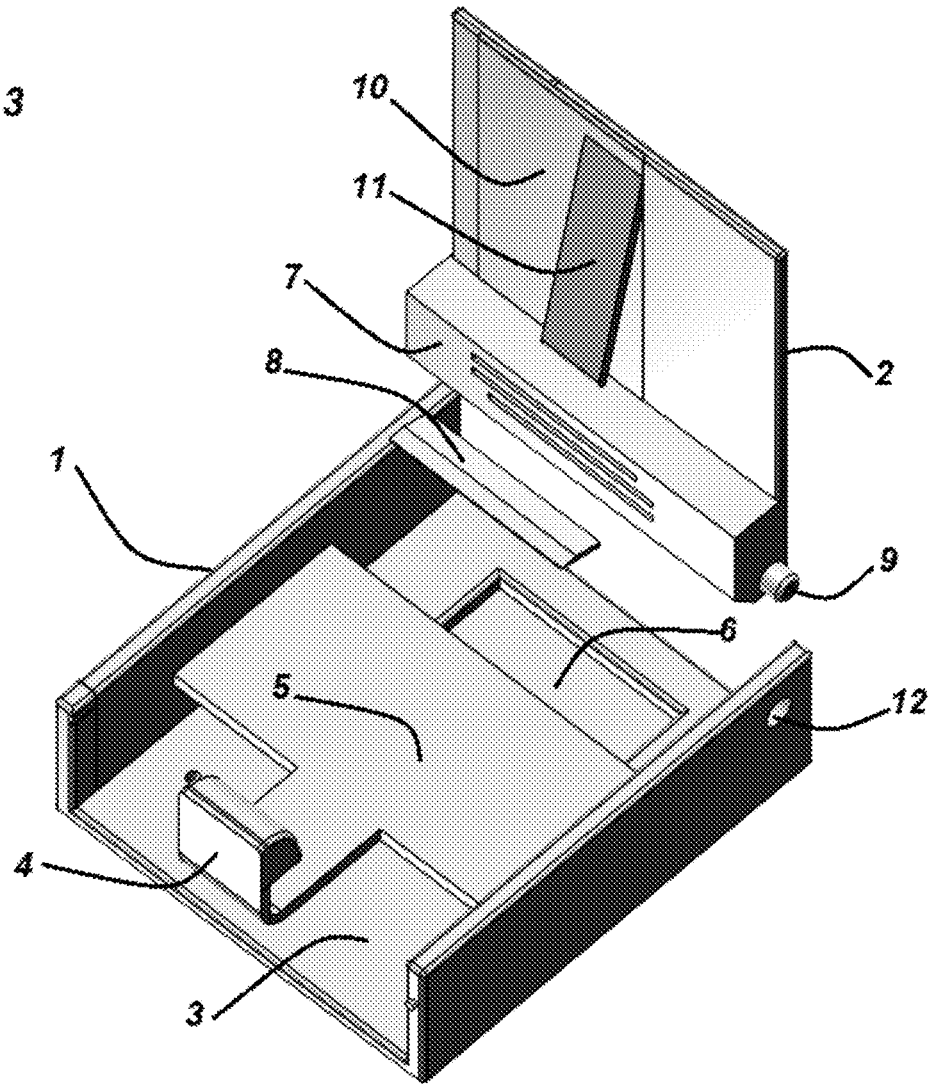
FIG. 3 illustrates in 3D isometric drawing a disassembled BRD.

FIG. 3 illustrates in 3D isometric drawing a disassembled BRD. FIG. 3 is very similar to FIG. 1 except that the BRD is disassembled in FIG. 3. The turning gate axles 9 are separated from their bearings 12 in FIG. 3.

Figure 4:
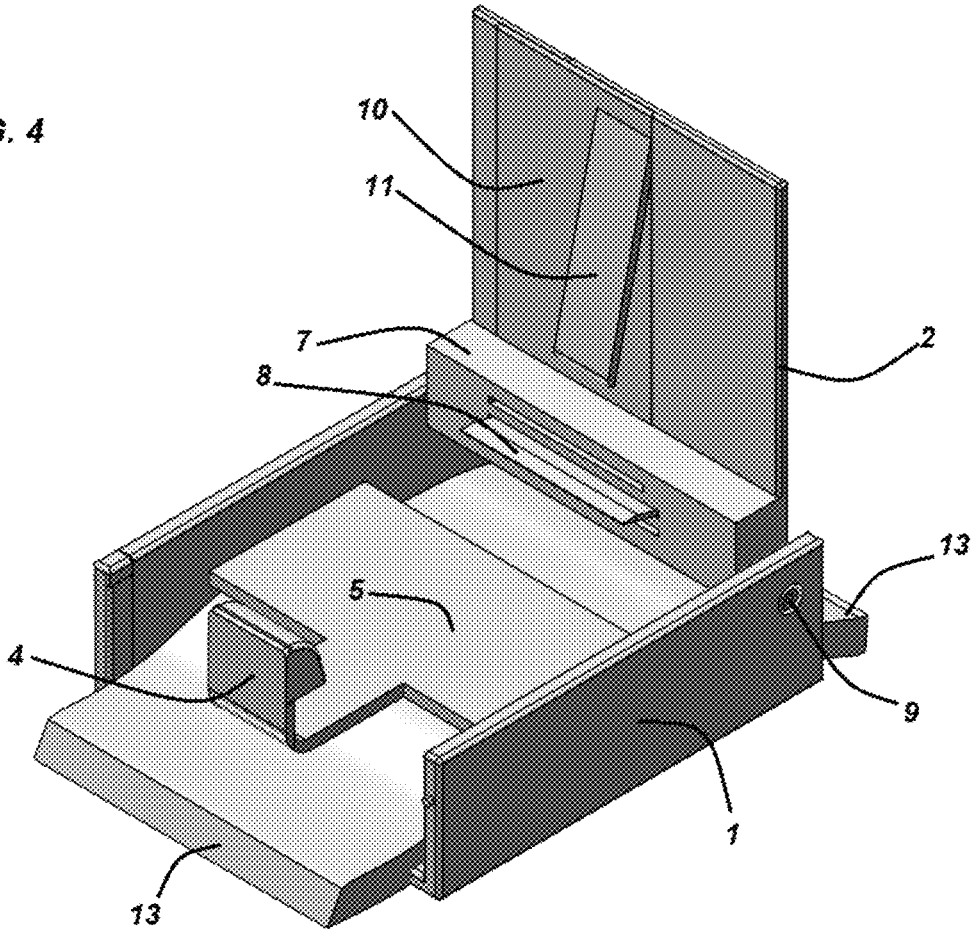
FIG. 4 shows in 3D isometric drawing a BRD in inactive state while inserted with a portion of the belt.

FIG. 4 illustrates in 3D isometric drawing the BRD in inactive state while inserted with a portion of the belt 13. The belt 13 is shown both in the channel's entrance (on the right side) and at the channel's exit (on the left side). Parallel and above the gripping wall 3 (which is not shown in FIG. 4) there is the middle floor wall 5, which is resiliently connected to the latch 4. The turning gate 2 which is turned upwards (backwards) and is in inactive state in FIG. 4. The blade holder 7 holds the blade 8 in one of 3 slots engraved in the blade holder 7. The turning gate turns on axes 9 which are inserted in bearings in the upper and lower side walls of the channel 1. The resilient plate 10 is the elastic part of the turning gate 2, which is attached to the blade holder 7. The resilient plate 10 is in unbent state in FIGS. 1 and 2 since the BRD is in inactive state. One end of the leaf spring 11 is attached to the lower face of the resilient plate 10. The other end of the leaf spring 11 is configured to be pressed against the middle floor wall 5 when the resilient plate 10 is turned backwards (down) when the BRD is in active state.

Figure 5:
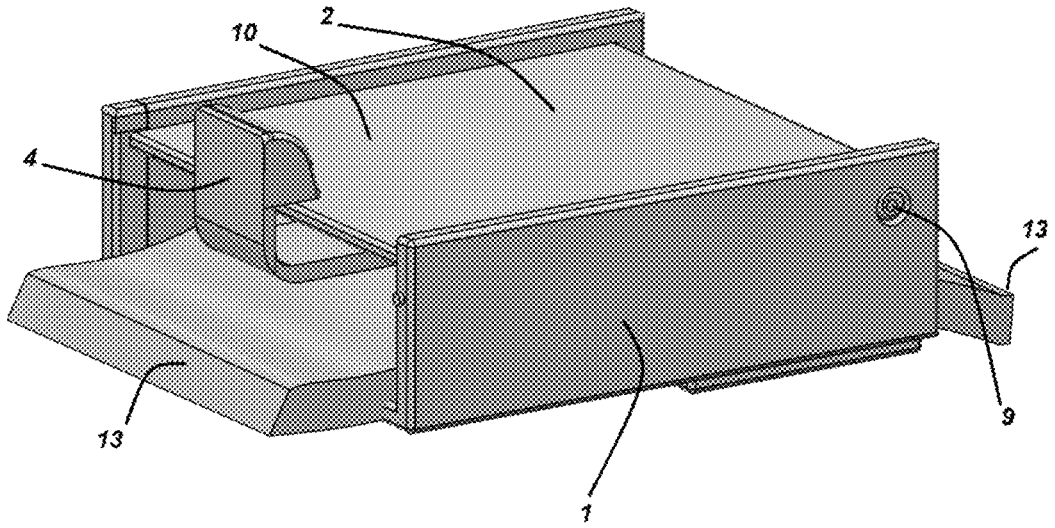
FIG. 5 illustrates in 3D isometric drawing a BRD in active state while inserted with a portion of the belt.

FIG. 5 illustrates in 3D isometric drawing a BRD 1 in active state while inserted with a portion of the belt 13. The resilient plate 10 is turned fully backwards (down) and is held in a bent state by the latch 4.

Figure 6:
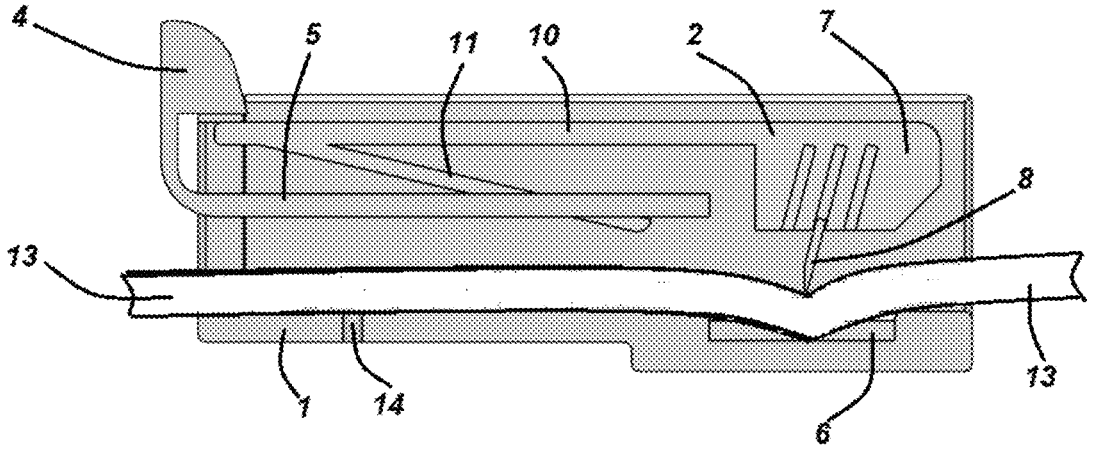
FIG. 6 illustrates in 3D isometric drawing a cross section of the BRD in active state while inserted with a portion of the belt.

FIG. 6 illustrates in 3D isometric drawing a cross section of the BRD in active state while inserted with a portion of the belt 13. The belt 13 is pressed against the gripping wall recess 6 by the sharp blade front 8, which is inserted in the blade holder 7. The resilient plate 10 is turned fully backwards (down) and is held in a bent state by the latch 4. The holes 14 are used for attaching to the BRD 1 the second end of a fastened belt.

Figure 7:
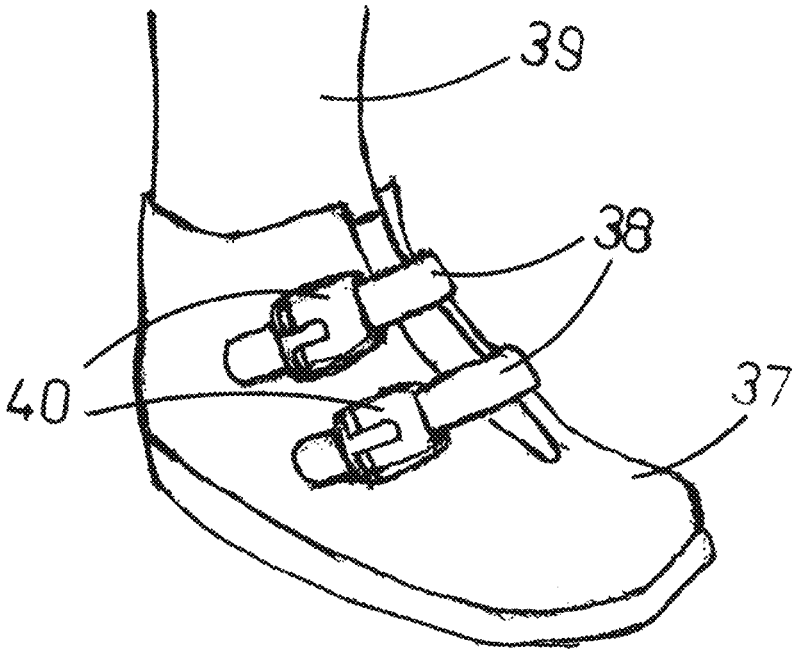
FIG. 7 depicts a footwear item with two BRDs which are fastening its belts.

FIG. 7 depicts a footwear item 37 on a leg 39 with two BRDs 40 which are fastening its belts 38.

What is claimed is:

1. A ratcheting device configured for fastening a belt and releasing a fastened belt;

wherein the ratcheting device comprising: a channel, a turning gate, a blade and said belt;

wherein the channel is being configured to carry through a portion of the belt;

said channel further comprises a gripping wall being adapted with a surface configured to engage said belt;

the ratcheting device has an active state and an inactive state;

the ratcheting device while in the active state is configured to restrict translation of the belt in the channel in a backwards direction and to facilitate translation of the belt in the channel in a forwards direction;

the ratcheting device while in the inactive state is configured to facilitate translation of the belt both in said forwards direction and in said backwards direction;

the turning gate being rotationally engaged with the channel at a fulcrum, wherein the turning gate comprises a blade holder attached to an elastic part;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forwards direction; wherein the blade front is disposed within the channel opposite the gripping wall; wherein the blade front is disposed opposite the gripping wall such that there is a gap between the blade front and the gripping wall; wherein the belt is configured to pass through the gap between the blade front and the gripping wall;

wherein, the turning gate is configured to reduce the gap and to increase a pressure force exerted by the blade front on the belt when the turning gate is turned increasingly backwards; wherein the turning gate is configured to increase the gap and to reduce the pressure force exerted by the blade front on the belt when the turning gate is turned increasingly forwards;

at the active state, the blade front is configured to exert the pressure force on the belt and the blade front is configured to frictionally engage the belt and to turn forwards the turning gate when the belt is translated in said forwards direction; also, at the active state the blade front is configured to frictionally engage the belt and to turn backwards the turning gate when the belt is translated in said backwards direction;

wherein the turning gate is configured to facilitate forwards translation of the belt by turning increasingly forwards and consequently diminishing the pressure force of the blade front on the belt;

wherein the turning gate is configured to restrict backwards translation of the belt by turning increasingly backwards and consequently increasing the pressure force of the blade front on the belt;

at the inactive state of the ratcheting device, the blade front is configured not to exert said pressure force on the belt and translation of the belt is facilitated both in the forwards direction and in the backwards direction.

2. The ratcheting device of claim 1, wherein said fulcrum comprises an axle which is fitted into a bearing.

3. The ratcheting device of claim 1, wherein said elastic part is structured as a resilient plate which acts as a flat spring which is attached to the blade holder; while in the active state, the resilient plate is configured to be at a bent state and is configured to apply said backwards turning force on the turning gate; wherein the backwards turning force is configured to turn the turning gate backwards, which is configured to reduce the gap and to apply the pressure force on the belt; wherein at the active state the turning gate is configured to apply a pressure force on the belt;

while in the active state, the resilient plate is held in the bent state by a latch which is resiliently attached to a middle floor wall of the ratcheting device; wherein when manually pulled, the latch is configured to release the resilient plate from the bent state; wherein the turning gate is configured to diminish the backwards turning force when the resilient plate is released and to switch the ratcheting device from the active state into the inactive state.

4. The ratcheting device of claim 1, wherein said blade is tapered towards the blade front; wherein the blade front ends with a sharp blade front; wherein the sharp blade front is adapted with a smooth side;

wherein, the sharp blade front is configured to concentrate said pressure force on the belt when the turning gate is turned backwards while the sharp blade front engages the belt;

wherein, the smooth side is configured to engage the belt when the turning gate is turned forwards;

wherein, the smooth side is configured to reduce said belt wear while the turning gate is turned forwards and the belt is translated in the forwards direction.

5. The ratcheting device of claim 1, wherein the surface of the gripping wall is adapted with a smooth surface;

wherein, the smooth surface is configured to reduce the belt wear when the belt is fastened at the active state and also when the belt is translated in the inactive state.

6. The ratcheting device of claim 1, wherein the ratcheting device further comprising one or more bulges disposed on the surface of the gripping wall; wherein said bulge is configured to cause an additional bending of the belt due to said pressure force;

wherein, said additional bending is configured to increase a mutual friction force between the belt and the surface of the gripping wall while said ratcheting device is in said active state and the belt is pulled in said backwards direction.

7. The ratcheting device of claim 1, wherein said belt further comprises a first belt end and a second belt end; wherein said ratcheting device is configured for said belt fastening by tying said second belt end to said ratcheting device and fastening said first belt end with said ratcheting device; wherein, when the belt is fastened, said first belt end is configured to pull said ratcheting device in said backwards direction, while second belt end is configured to pull in said forwards direction the belt ratcheting device.

8. The ratcheting device of claim 4, wherein said sharp blade front is split into at least two split sharp blade fronts each with a split smooth side;

wherein, each of the split sharp blade fronts is configured to concentrate said pressure force on the belt when the turning gate is turned backwards;

wherein, each of the split smooth sides is configured to engage the belt when the turning gate is turned forwards;

whereby, each of the split smooth sides is configured to reduce said belt wear when the belt is translated in the forwards direction.

9. The ratcheting device of claim 1, wherein at least one ratcheting device which is anchored to a footwear item, is configured to fasten said belt which is attached to the footwear item.

10. The ratcheting device of claim 3, wherein the resilient plate is attached to a leaf spring at a leaf spring first end; wherein a leaf spring second end is unattached and is situated below the resilient plate;

wherein when the resilient plate is rotated downwards towards the active state, the first end of the leaf spring is configured to move downwards as well and the second end of the leaf spring is configured to be pressed against the middle floor wall of the ratcheting device while bending the leaf spring;

when the ratcheting device is at the active state and the latch is pulled, the resilient plate is configured to turn forwards the turning gate and the bent leaf spring is configured to be released and to facilitate turning forwards the resilient plate and the turning gate towards the inactive state.

11. The ratcheting device of claim 1, wherein the gripping wall further comprises a recess opposite the blade front end;

wherein said recess is configured to cause an additional bending of the belt due to said pressure force;

wherein, said additional bending is configured to increase a mutual friction force between the belt and the surface of the gripping wall while said ratcheting device is in said active state and the belt is pulled in said backwards direction.

12. The ratcheting device of claim 1, wherein the elastic part is being configured also to serve as a lever for manually switching the ratcheting device from the active state into the inactive state by manually turning down the resilient plate which also turns forwards the turning gate and consequently diminishing the pressure force exerted by the blade front on the belt;

wherein the elastic part is being configured also to serve as a lever for manually switching the ratcheting device from the active state into the inactive state by manually turning up the resilient plate which also turns backwards the turning gate and consequently increasing the pressure force exerted by the blade front on the belt.

13. The ratcheting device of claim 1, wherein the turning gate is made of plastic materials.

14. The ratcheting device of claim 1, wherein the blade is made of metal.

15. The ratcheting device of claim 1, wherein the entire ratcheting device except the blade is made of plastics materials.

* * * * *